US011761588B2

(12) United States Patent
Gosset et al.

(10) Patent No.: US 11,761,588 B2
(45) Date of Patent: Sep. 19, 2023

(54) DEVICE FOR TRANSFERRING A FLUID FROM A SUPPLY TANK TO A RECEIVER TANK

(71) Applicant: GAZTRANSPORT ET TECHNIGAZ, Saint Remy les Chevreuse (FR)

(72) Inventors: Maxime Gosset, Saint-Remy-les-Chevreuse (FR); Arnaud Bouvier, Saint-Remy-les-Chevreuse (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 92 days.

(21) Appl. No.: 17/620,488

(22) PCT Filed: Jun. 17, 2020

(86) PCT No.: PCT/FR2020/051052

§ 371 (c)(1),
(2) Date: Dec. 17, 2021

(87) PCT Pub. No.: WO2020/254762

PCT Pub. Date: Dec. 24, 2020

(65) Prior Publication Data

US 2022/0356993 A1 Nov. 10, 2022

(30) Foreign Application Priority Data

Jun. 21, 2019 (FR) ..... 1906697

(51) Int. Cl.
*F17C 9/00* (2006.01)
*F17C 13/02* (2006.01)

(52) U.S. Cl.
CPC ..... *F17C 9/00* (2013.01); *F17C 13/025* (2013.01); *F17C 2205/0329* (2013.01); *F17C 2205/0338* (2013.01); *F17C 2205/0367* (2013.01); *F17C 2221/033* (2013.01); *F17C 2223/0153* (2013.01); *F17C 2223/033* (2013.01); *F17C 2225/033* (2013.01); *F17C 2227/04* (2013.01);

(Continued)

(58) Field of Classification Search
USPC ..... 141/5
See application file for complete search history.

(56) References Cited

U.S. PATENT DOCUMENTS

2006/0254676 A1* 11/2006 Pechtold ..... F17C 9/00 141/198

FOREIGN PATENT DOCUMENTS

| | | |
|---|---|---|
| DE | 10 2016 220 822 A1 | 4/2018 |
| FR | 2 997 165 A1 | 4/2014 |
| FR | 3 017 183 A1 | 8/2015 |

OTHER PUBLICATIONS

International Search Report dated Nov. 18, 2020 in PCT/FR2020/051052 filed on Jul. 17, 2020, 2 pages.

* cited by examiner

*Primary Examiner* — Timothy P. Kelly
*Assistant Examiner* — Christopher M Afful
(74) *Attorney, Agent, or Firm* — Oblon, McClelland, Maier & Neustadt, L.L.P.

(57) ABSTRACT

A device for transferring a fluid from a supply tank to a receiver tank includes at least one duct for charging the receiver tank with liquid and at least one duct for return of the gas. The gas return duct is configured to transfer the gas contained in the receiver tank at a pressure close to or significantly different from the pressure of the supply tank.

16 Claims, 4 Drawing Sheets

(52) U.S. Cl.
CPC ..... *F17C 2250/043* (2013.01); *F17C 2250/0626* (2013.01); *F17C 2265/06* (2013.01); *F17C 2270/0105* (2013.01)

DEVICE FOR TRANSFERRING A FLUID FROM A SUPPLY TANK TO A RECEIVER TANK

The present invention relates to a device for transferring a fluid and relates more particularly to the transfer of liquid between a first structure and a second structure.

It is known practice to use a barge to supply liquid natural gas (LNG) to a ship that is docked or offshore. This barge then acts as a resupply ship which supplies this LNG, in particular when this LNG is used as a fuel for propelling the ship. This barge thus comprises LNG storage tanks, in particular membrane tanks for storing the LNG at atmospheric pressure and at −163° C.

The barge conventionally has a device for transferring a fluid, which has a liquid loading pipe connected to the tank of the ship in order to transfer the fluid in the liquid state, and a gas return pipe which makes it possible both to evacuate the gas phase present in the tank of the ship during the loading of the liquid phase and to inject this gas phase into the tank of the barge in order to maintain a stable pressure in the latter.

A problem arises when pressure differences are ascertained between the pressure in the tank of the ship and the pressure that the tank of the barge can withstand. Specifically, the tank of the barge stores LNG at more or less atmospheric pressure. For its part, the tank of the ship can store LNG at atmospheric pressure, in particular in a membrane tank, or at a higher pressure, in particular in a tank known as a spherical or cylindrical tank. When a barge membrane tank is used to load a spherical tank of a ship, the use of a gas return may prove to be complicated or proscribed since a pressure that is too high may damage the membrane tank of the barge.

Therefore, the aim of the invention is to provide a fluid transfer device that can be used for loading LNG both onto ships with tanks subjected to high pressure and to ships with tanks at atmospheric pressure. The invention therefore covers a device for transferring a liquefied gas from a supply tank of a first structure to a receiving tank of a second structure, at least one of the structures being a floating structure, the transfer device comprising at least one pipe for loading the receiving tank with liquid and at least one pipe for returning the gas present in the receiving tank to the supply tank, characterized in that the gas return pipe comprises at least one pressure regulation system comprising at least one first branch equipped with an expansion member for expanding the gas and a second branch disposed in parallel with the expansion member and equipped with a valve configured to allow or interrupt circulation of the gas in the second branch.

The supply tank may in particular be a tank of a floating structure such as a barge and the receiving tank may be a tank of a liquefied gas transport ship, said tank being used as a fuel reservoir for supplying this fuel to a consuming member on the ship, for example the propulsion system. The supply tank thus forms the tank from which the fluid to be transferred is taken in order to fill the receiving tank. The supply tank or the receiving tank may also be that of an onshore structure, such as an onshore tank or train for loading with liquid gas or an onshore tank or train for receiving liquefied gas shipped by sea.

The liquid gas decanted from the supply tank to the receiving tank may be liquefied natural gas (LNG), the return pipe then being passed through by a gas phase of the LNG. The fluid transfer device thus makes it possible to transfer LNG from the supply tank to the receiving tank, passing through the liquid loading pipe.

During the loading of the receiving tank, it is necessary to evacuate the gas while it is being filled in order that the pressure thereof does not rise during the filling step, such a rise in pressure slowing down the filling of the receiving tank by exerting a counterpressure. Such a rise in pressure could damage the receiving tank when this tank is a membrane receiving tank.

Similarly, during this operation of filling the receiving tank, it is necessary to stabilize the pressure in the supply tank to avoid the generation of negative pressure therein. The transfer device according to the invention avoids this situation by allowing the gas to return to the supply tank at a flow and pressure that are compatible with the filling. This is the role of the gas return pipe connecting the receiving tank to the supply tank that then makes it possible to transfer the gas from the receiving tank to the supply tank.

The tanks may have similar pressures or significantly different pressures, the latter scenario requiring adjustment of the gas pressure before it enters the supply tank. A pressure regulation system thus allows this pressure adjustment by creating different passages in the event of similar pressures or different pressures.

The first branch thus comprises the gas expansion member, while the second branch comprises the valve configured to allow or interrupt circulation of the gas in the second branch. The expansion member generates a pressure drop on the gas arriving from the supply tank, while the valve configured to allow or interrupt circulation of the gas in the second branch is an all or nothing valve in that it is used open or closed but never in between. In the following text, this valve configured to allow or interrupt circulation of the gas in the second branch will be referred to as first valve. Said first valve thus allows the gas coming from the receiving tank to pass without a pressure drop. This first valve thus allows more rapid return of the gases since it does not generate a pressure drop. The flow rate of gas circulating in the branch bearing the first valve is thus greater than that of the gas which circulates in the branch bearing the expansion member.

According to one feature of the invention, a control device operates the valve configured to allow or interrupt circulation of the gas in the second branch depending on a first pressure measured on the gas return pipe.

The first pressure may for example be measured downstream of the pressure regulation system.

The terms downstream—upstream are defined with respect to the direction of circulation of the gas in the gas return pipe. The terms downstream—upstream may also be used to denote the position of elements on the gas return pipe, depending on the direction of circulation of the gas in the gas return pipe, that is to say from the receiving tank to the supply tank.

The control device is in particular made up of a measurement device for measuring the first pressure of the supply tank and of a pneumatic or hydraulic control member for opening or closing the valve configured to allow or interrupt circulation of the gas in the second branch, depending on the pressure measured by the measurement device.

According to an alternative feature of the invention, the first pressure may be measured upstream of the pressure regulation system. Upstream is understood as meaning that the pressure is measured at the outlet of the receiving tank and before the pressure regulation system.

According to one feature of the invention, the pressure regulation system is configured to keep the valve, itself configured to allow or interrupt circulation of the gas in the second branch, closed when the first pressure measured on the gas return pipe is higher than a first safety threshold, the gas passing through the expansion member. In other words, the system forces the return gas to pass through the expansion member when the pressure measured on the gas return pipe is above the first safety threshold. The first safety threshold is set for example at 0.63 barg.

According to one feature of the invention, the pressure regulation system is configured to keep the valve, configured to allow or interrupt circulation of the gas in the second branch, open when the first pressure measured on the gas return pipe is lower than or equal to a first safety threshold. In this situation, advantage will be taken of the first valve, which does not generate a pressure drop, compared with the expansion member. The gas flow rate can thus be kept at a high level, thereby reducing the time for filling the receiving tank. The first safety threshold is identical to the one mentioned above and is set for example at 0.63 barg.

According to one feature of the invention, the expansion member is controlled mechanically. The expansion member then has an element that an operator can actuate manually directly on the expansion member, for example a tap, such a mechanical element thus making it possible to regulate the pressure downstream of the expansion member.

According to one feature of the invention, the expansion member makes it possible in particular to generate a minimum pressure drop of 0.250 bar on the gas circulating in the gas return pipe, such a pressure drop furthermore being adjustable by the mechanical control of the expansion member.

According to one feature of the invention, the supply tank is configured to operate at a pressure of between 0.05 barg and 0.700 barg, while the receiving tank is configured to operate at a pressure of between 0.05 barg and 10 barg.

In other words, the supply tank is configured as a membrane tank while the receiving tank can be a tank of any type, for example a type B or C tank.

The downstream pressure, corresponding to the first pressure measured in the supply tank and the pressure upstream of the pressure regulation system can be adjusted between these two limits by virtue of the mechanical control of the expansion member.

The above is understood as meaning that when the pressure measured by the control device, and in particular by its measurement device disposed downstream of the pressure regulation system, is higher than the first safety threshold, the first valve is closed under the action of the pneumatic or hydraulic control member of the control device. Such a configuration forces the gas to pass through the first branch of the gas return pipe, that is to say through the expansion member, making it possible to reduce the pressure of the gas by a pressure drop before it enters the supply tank.

When the pressure measured by the measurement device downstream of the pressure regulation system is lower than or equal to the first safety threshold, the pneumatic or hydraulic control member keeps the first valve open. Such a configuration allows the gas to pass through the first valve of the second branch of the gas return pipe without a pressure drop, thereby making it possible to enhance the gas return and thus to reduce the time necessary for filling a receiving tank.

A first pressure measurement member makes it possible to measure the first pressure which prevails in the supply tank and compares it with a fourth safety threshold corresponding to a maximum pressure value defined by the operator. This fourth safety threshold can be set at 0.63 barg and if this is exceeded, this activates a first response member. The first response member thus responds to this exceeding of the fourth safety threshold, measured by the first measurement member, by closing the pressure control valve by sending a signal.

A second pressure measurement member makes it possible to measure the first pressure which prevails in the supply tank and compares it with a fifth safety threshold corresponding to a maximum pressure value defined by the operator. This fifth safety threshold can be set at 0.65 barg and if this is exceeded, this activates a second response member. The second response member thus makes it possible to send a signal to the pressure control valve so that it closes.

The second pressure measurement member also communicates with a third response member. The third response member is then activated by the second measurement member when the first pressure measured by the latter exceeds a sixth safety threshold equal to 0.67 barg. The third response member then sends a signal to the pressure control valve in order that the latter remains closed, and also a signal to a release valve disposed at the end of the gas return pipe, the signal opening said release valve. The opening of the release valve makes it possible to evacuate the gas in the supply tank out of the latter, that is to say into the atmosphere, via a vent tube. The evacuation of the gas out of the supply tank thus makes it possible to reduce the pressure prevailing in said supply tank.

According to one feature of the invention, the expansion member is configured to manage an inlet pressure of the gas, the range of values of which is between a first value and a second value, and to set a gas outlet pressure, the range of values of which is between a third value and a fourth value.

The first value may for example be 0.05 barg and the second value may be 9 barg. The second value corresponds to a maximum pressure value of the gas which can be managed by the expansion member. The third value may for example be 0.05 barg and the fourth value may be 0.8 barg.

It will be understood from the above that the expansion member generates a pressure drop in the pressure of the gas circulating in the first branch.

According to one feature of the invention, the valve configured to allow or interrupt circulation of the gas in the second branch allows gas circulation in the second branch up to a fifth pressure value of the gas, the fifth value being higher than the first value and lower than the fourth value.

The fifth value may be equal to 0.63 barg and higher than the first value, while being strictly less than the fourth value corresponding to the maximum value of the pressure leaving the expansion member of the first branch. The fifth value is thus similar to the first pressure which prevails in the supply tank. It will be understood that the first valve allows the gas, the pressure of which is substantially equal to the fifth value of 0.63 barg, to pass through, the first valve not making it possible to generate a pressure drop in the gas circulating in the gas return pipe before it enters the supply tank.

According to one feature of the invention, the gas return pipe comprises a pressure control valve disposed between the pressure regulation system and the supply tank.

The pressure control valve is an expansion valve configured to effect expansion of the gas circulating in the gas return pipe in order to stabilize the pressure at the inlet of the supply tank. More specifically, the pressure control valve makes it possible to generate a pressure drop in the gas at the outlet of the pressure regulation system. To this end, the pressure control valve comprises a control interface driven electrically by an operator of the ship who defines the acceptable inlet pressure in the supply tank. The pressure control valve thus has a safety role with respect to the pressure regulation system, for example in the case of malfunctioning of the control device of the pressure regulation system or when the pressure drop in the gas at the outlet of the pressure regulation system proves insufficient for the inlet thereof into the supply tank. The pressure control valve may thus comprise three pressure measurement members, all disposed downstream of the pressure regulation system at different points of the fluid transfer device.

According to one feature of the invention, the pressure control valve manages an inlet pressure of the gas, the range of values of which is between the third value and the fourth value, and sets a gas outlet pressure, the range of values of which is between the third value and a sixth value lower than the fourth value.

The sixth value may be for example equal to 0.4 barg. It will thus be understood that the pressure control valve allows a final adjustment of the pressure of the gas circulating in the gas return pipe, as it leaves the pressure regulation system. The pressure between the third value and the sixth value is the pressure that is acceptable for the supply tank.

According to one feature of the invention, the gas return pipe comprises a safety device disposed between the receiving tank and the pressure regulation system and configured to interrupt the circulation of the gas in the gas return pipe when the gas pressure measured between the pressure control valve and the supply tank exceeds a second safety threshold with a value higher than the sixth value.

According to one feature of the invention, the safety device is configured to interrupt the circulation of the gas in the gas return pipe when the gas pressure measured between the receiving tank and the safety device exceeds a third safety threshold with a value higher than the second value.

The safety device comprises a first pressure measurement element disposed between the pressure regulation system and the supply tank. The first pressure measurement element is thus configured to measure the pressure of the gas circulating in the gas return pipe, and in particular the pressure prevailing in the supply tank, and to compare it with the second safety threshold corresponding to the seventh value. The seventh value may then be equal to 0.66 barg.

The safety device comprises a second pressure measurement element disposed between the receiving tank and the pressure regulation system. The second pressure measurement element is thus configured to measure the pressure of the gas circulating in the gas return pipe, and to compare it with the third safety threshold corresponding to the second value, equal to 9 barg.

The safety device may thus comprise two measurement elements, with the first element for measuring the pressure downstream of the pressure regulation system making it possible, when the pressure measured reaches a second safety threshold set at the seventh value, to close a safety valve positioned at the outlet of the receiving tank. The second element for measuring the pressure upstream of the pressure regulation system, that is to say on the return pipe at the outlet of the receiving tank, makes it possible, if a pressure higher than the third safety threshold corresponding to the second value is measured, to close the safety valve positioned at the outlet of the receiving tank. Thus, the third safety threshold is defined as being higher than the first safety threshold. More specifically, the third safety threshold corresponds to a pressure at the second value that can no longer be managed by the expansion member, which is no longer capable of lowering the pressure to the level accepted by the supply tank.

The transfer device may comprise at least one isolation valve disposed on the gas return pipe.

The isolation valve is a manually controlled valve, having an ultimate safety function. It is closed manually by the operator, in particular in the event of malfunctioning of the other safety systems of the gas return pipe that are mentioned above.

The invention also covers a structure comprising at least one device for transferring a fluid comprising any one of the above features and at least one tank intended to contain gas in the liquid state, advantageously natural gas in the liquid state. The tank may be the supply tank or the receiving tank of the structure and the fluid transfer device according to the invention is advantageously disposed on the floating structure.

The floating structure may in particular be a barge comprising the supply tank, which serves to bunker the ships of a port such as methane tankers, container ships, bulk carriers or cruise ships. In such a case, the receiving tank may be a fuel reservoir for the propulsion of the floating structure.

The invention also covers a system for loading a liquid natural gas, which combines at least one structure comprising the receiving tank intended to contain liquid natural gas and at least one structure according to the preceding feature and which comprises at least the supply tank, at least one of these structures being a floating structure.

The invention also relates to a method for transferring a liquid natural gas from a supply tank to a receiving tank, which employs a fluid transfer device according to any one of the preceding features relating to the transfer device.

According to one feature of the transfer method, the valve configured to allow or interrupt circulation of the gas in the second branch is kept closed when the first pressure measured on the gas return pipe, for example upstream or downstream of the pressure regulation system, is higher than a first safety threshold, the gas then passing through the expansion member, or the valve configured to allow or interrupt circulation of the gas in the second branch is kept open when the first pressure measured on the gas return pipe, for example upstream or downstream of the pressure regulation system, is lower than or equal to the first safety threshold.

Further features, details and advantages of the invention will become more clearly apparent from reading the following description, and from several exemplary embodiments that are given by way of nonlimiting indication with reference to the appended schematic drawings, in which.

The features, variants and different embodiments of the invention can be combined with one another, in various combinations, provided that they are not mutually incompatible or exclusive. It will be possible, in particular, to imagine variants of the invention that comprise only a selection of the features described below, in isolation from the other features described, if this selection of features is sufficient to confer a technical advantage or to distinguish the invention from the prior art.

Figure 1:
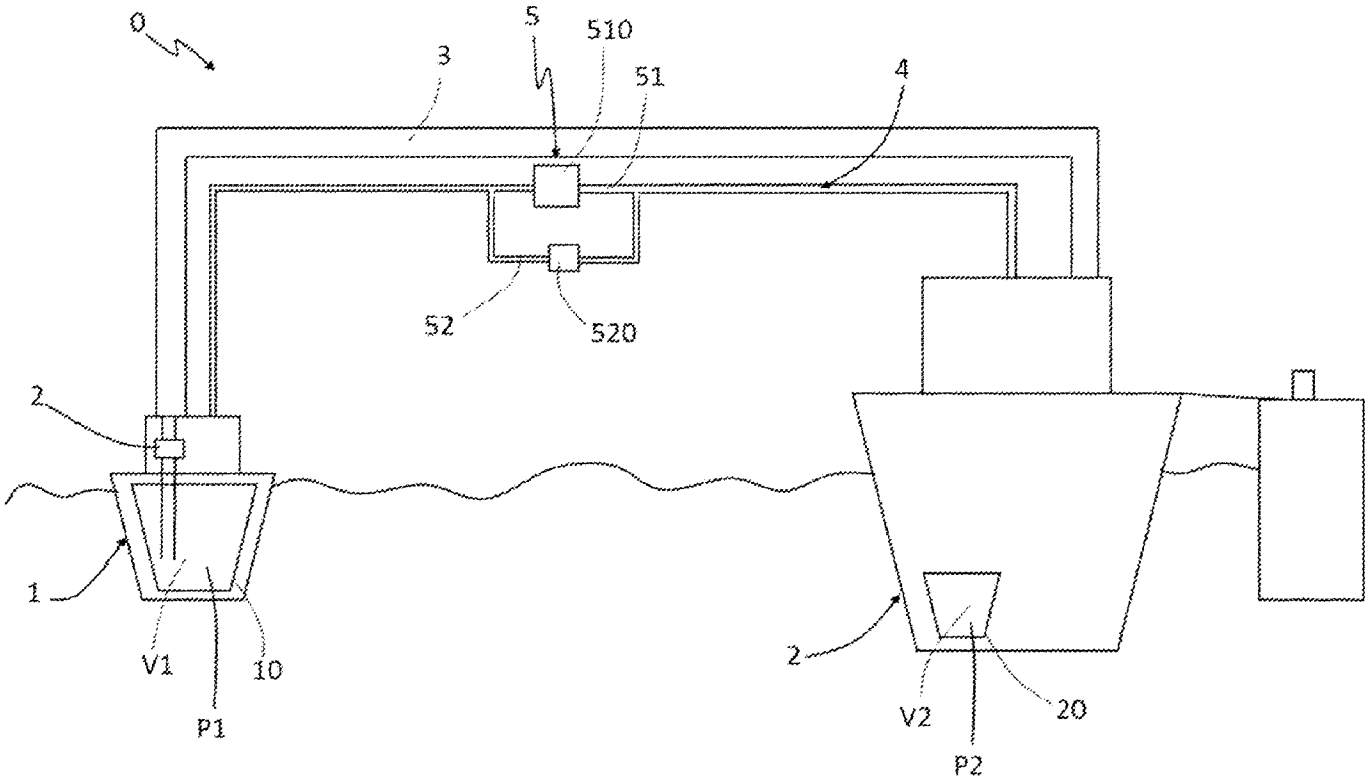
FIG. 1 is a schematic view of a device for transferring a fluid according to the invention.

FIG. 1 illustrates a first structure 1 comprising a supply tank 10 and a second structure 2 comprising a receiving tank 20. In the example illustrated, the first structure 1 is a floating structure and may be in particular a barge. Likewise, the second structure 2 is a floating structure and may be for example a ship of the methane tanker, bulk carrier, container ship or cruise ship type. Alternatively, at least one of the structures may be an onshore structure.

The supply tank 10 has a first internal volume V1 which contains a liquid cargo, in particular natural gas in the liquid state at a first pressure P1 of between 0.05 barg and 0.700 barg and at a temperature of between −163° C. and −155° C. For this purpose, the supply tank 10 has a supply tank 10 wall comprising at least one insulation layer and a membrane. The membrane thus constitutes the part in contact with the liquid cargo and may have corrugations so as to better withstand the mechanical impacts of the liquid cargo against the tank wall. According to the invention, the supply tank 10 is a membrane tank, meaning one made up of a primary layer and of a secondary layer, each layer comprising a membrane which ensures leaktightness and a thickness of thermally insulating material, so as to insulate the contents of the supply tank 10 from the exterior environment thereof.

The receiving tank 20 has a second internal volume V2 which contains a liquid cargo, in particular natural gas in the liquid state at a second pressure P2 and at a temperature of between −163° C. and −130° C. The second pressure P2 may be a pressure similar to the first pressure P1 that prevails in the supply tank 10. The receiving tank 20 then comprises a receiving tank 20 wall that may exhibit similar technology to that of the supply tank 10, i.e. be a membrane tank, with a pressure of up to 0.700 barg. Alternatively, and this is the full benefit of the invention, the receiving tank 20 can be made with type B or C technology, meaning tanks with self-supporting walls capable of withstanding pressures of between 1 barg and 10 barg. These tanks are recognizable in that they are in the form of a sphere or a prism.

The aim of the first floating structure 1 is to supply the receiving tank 20 of the second floating structure 2 with liquid natural gas. For this purpose, a fluid transfer device 0 is disposed between the receiving tank 20 and the supply tank 10 so as to link them. The fluid transfer device 0 is made up of at least one liquid loading pipe 3 and a gas return pipe 4.

The liquid loading pipe 3 is in the form of a tube through which liquid cargo circulates in order to pass from the supply tank 10 of the first floating structure 1 to the receiving tank 20 of the second floating structure 2. This transfer of fluid in the liquid state is effected by means of a pump 2. During such a transfer, the liquefied natural gas extracted from the supply tank 10 frees up the first internal volume V1 of the latter, while the liquefied natural gas arriving in the receiving tank 20 fills the second internal volume V1 of this receiving tank 20.

At the supply tank 10, the offloading of the liquefied natural gas brings about variations in pressure which it is necessary to stabilize, so as not to damage the wall of the supply tank 10. At the receiving tank 20, the loading of the latter increases the second pressure P2 in the second internal volume V2. Such an increase in the second pressure P2 in the second internal volume V2 may not only damage the receiving tank 20 but also damage the decanting pumps (not shown), which would then have to exert a greater thrust force in order to counterbalance a counterpressure in the second internal volume V2. It is therefore necessary to evacuate the gas during the bunkering of the receiving tank 20 in order to lower this pressure in the second internal volume V2.

For its part, the gas return pipe 4 is disposed between the receiving tank 20 and the supply tank 10 such that it links them.

The gas return pipe 4 makes it possible, during the bunkering of the receiving tank 20, to transfer the gas from the second internal volume V2 into the first internal volume V1 of the supply tank 10. In other words, the gas in the second internal volume V2 that needs to be evacuated from the receiving tank 20 in order to avoid a rise in pressure thereof while it is being filled, is injected into the first internal volume V1 of the supply tank 10 in order to stabilize the first pressure P1 of the first internal volume V1.

The benefit of such a transfer device is in particular that the expulsion of the gas into the atmosphere is avoided and also that a stable pressure is maintained in the supply tank 10 of the first structure 1.

As mentioned above, the supply tank 10 stores the liquefied natural gas and has a gas headspace at the first pressure P1 while the receiving tank 20 contains the liquefied natural gas and a gas headspace at the second pressure P2. The aim of the gas return pipe 4 is mainly to keep the first pressure P1 in the supply tank 10 constant during the bunkering operation.

The second pressure P2 in the receiving tank 20 may be similar to the first pressure P1, but it may also be very different if the receiving tank 20 of the second structure 2 has load-bearing walls, that is to say walls capable of withstanding a pressure of 10 barg. It will thus be understood that a problem arises when the first pressure P1 and the second pressure P2 are different. Specifically, the return of gas to the supply tank 10 with gas at a higher pressure could damage it.

Thus, according to the invention, the gas return pipe 4 has a pressure regulation system 5. The pressure regulation system 5 is in the form of a system which comprises a first branch 51 for the gas to pass through and a second branch 52 for the gas to pass through. The first branch 51 has a gas expansion member 510 while the second branch 52 has a valve 520 configured to allow or interrupt circulation of the gas in the second branch.

The gas expansion member 510 is in the form of a mechanical control member, meaning that it comprises an element that can be actuated by an operator, for example a tap. The expansion member 510 thus has the function of reducing the pressure of the gas passing through the first branch 51. By contrast, the valve 520 configured to allow or interrupt circulation of the gas in the second branch is an all-or-nothing valve, in that it is either open or closed, but never in between. For ease of understanding, the valve 520 configured to allow or interrupt circulation of the gas in the second branch will be referred to as first valve in the rest of the detailed description. The first valve 520 allows the gas to pass through the second branch 52 without a significant modification of its pressure. The first valve 520 is therefore an alternative to the gas expansion member 510 of the first branch 51, when the pressure downstream of the regulation system 5 remains below a given pressure threshold.

It will be understood from the above that the gas return pipe 4 allows the use of gas of the receiving tank 20 both when the second pressure P2 is similar to the first pressure P1 but also when the pressures P1, P2 are very different.

Figure 2:
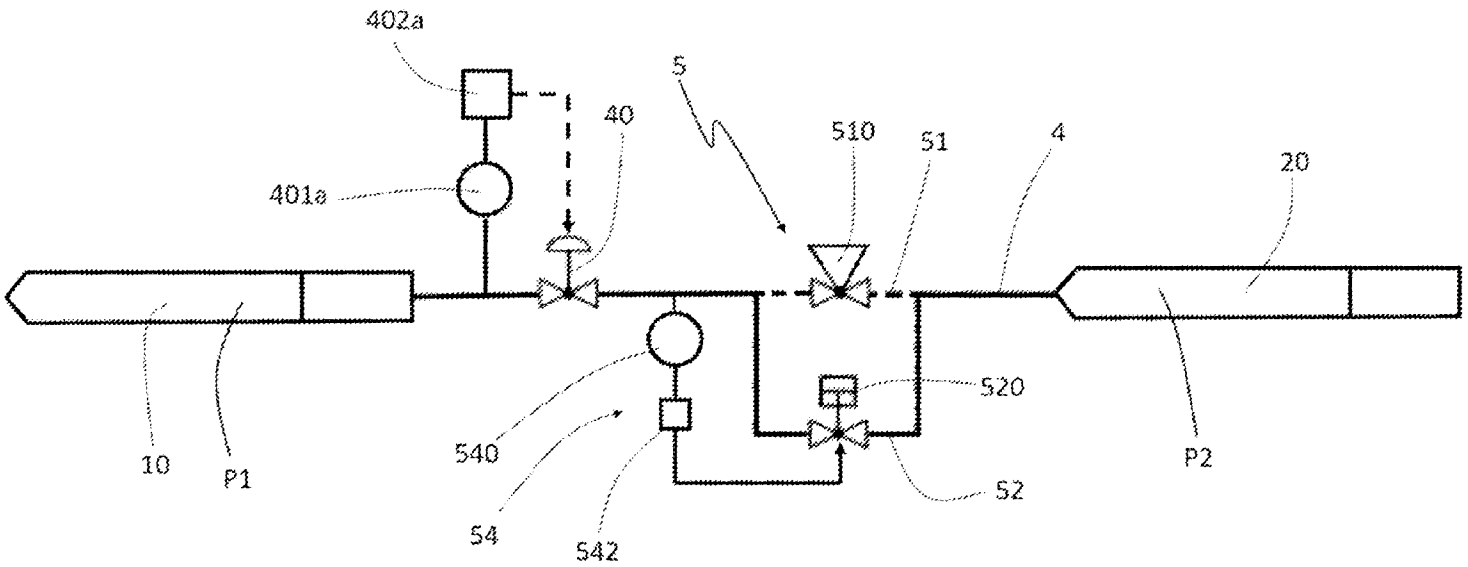
FIG. 2 is a schematic view of a constituent pressure regulation system of the fluid transfer device in FIG. 1 in a first configuration.
Figure 3:
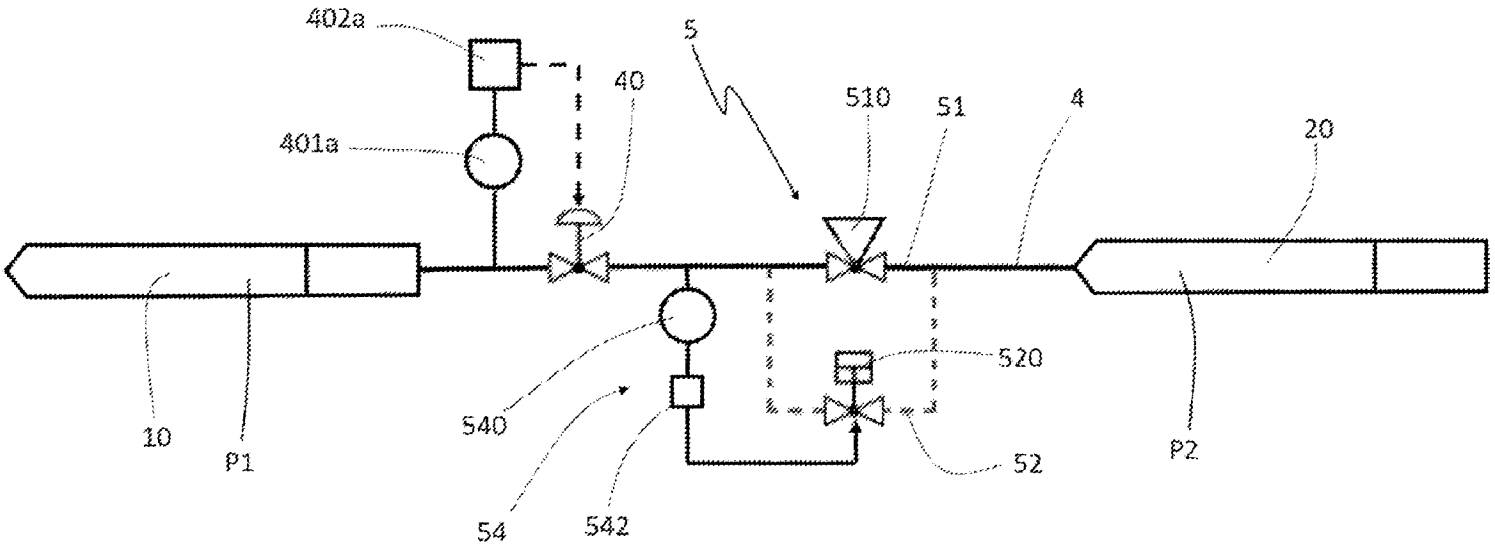
FIG. 3 is a schematic view of the constituent pressure regulation system of the fluid transfer device according to the invention in a second configuration.

The pressure regulation system 5 will now be described in more detail by means of FIG. 2, showing a first configuration of the fluid transfer device, and FIG. 3, showing a second configuration of the fluid transfer device. It should be remembered that the gas return pipe 4 comprises other elements in addition to the pressure regulation system 5 and that these will be described in detail in the rest of the description on the basis of FIG. 4. Likewise, six safety thresholds and seven different values will be set out in the rest of the description but in a nonlinear manner, the numbering not representing in any way an order of importance of the safety thresholds and of the different values.

FIG. 2 illustrates the pressure regulation system 5 of the gas return pipe 4 with, in particular, the first branch 51 comprising the gas expansion member 510 and the second branch 52 comprising the first valve 520.

The supply tank 10 comprises the liquid natural gas and a tank headspace, meaning the gas headspace at the first pressure P1 equal to 0.4 barg. In this first configuration of the fluid transfer device, the receiving tank 20 contains the liquid natural gas and its gas headspace at the second pressure P2 similar to the first pressure P1, i.e. about 0.4 barg. This first configuration of the fluid transfer device therefore corresponds to the situation in which the supply tank 10 and the receiving tank 20 are both membrane tanks.

A control device 54 of the pressure regulation system 5 is positioned in parallel with said pressure regulation system 5. The control device 54 comprises in particular a measurement device 540 and a pneumatic or hydraulic control member 542. The measurement device 540 makes it possible to measure, on the gas return pipe 4, the first pressure P1, i.e. the first pressure P1 of the supply tank 10. More specifically, the first pressure P1 is measured downstream of the pressure regulation system 5. The pneumatic or hydraulic control member 542 thus makes it possible to act on the first valve 520, in particular by closing it. More specifically, the pneumatic or hydraulic control member 542 acts on the first valve 520 depending on the first pressure P1 measured by the measurement device 540 of the control device 54. If the first pressure P1 exceeds a first safety threshold, the pneumatic or hydraulic control member 542 closes the first valve 520. This first safety threshold may be for example a fifth value E equal to 0.63 barg. In other words, the first valve 520 manages a gas inlet pressure equal to the fifth value E and sets a gas outlet pressure equal to the fifth value E, i.e. without a pressure drop.

During the bunkering of the receiving tank 20, the first pressure P1 of the supply tank 10 needs to remain stable and lower than 0.63 barg, in order not to damage it. To this end, the first safety threshold set at 0.63 barg makes it possible, if said value is exceeded, to close the first valve 520. More specifically, when the first pressure P1 measured by the measurement device 540 exceeds the first safety threshold equal to the fifth value E set at 0.63 barg, the latter sends a signal to the pneumatic or hydraulic control member 542 in order that it closes the first valve 520.

In this first configuration of the fluid transfer device, the supply tank 10 and the receiving tank 20 both comprise gas headspaces at a first pressure P1 and a second pressure P2 that are similar but different. A pressure difference of around 0.100 to 0.150 bar generally allows the gas to flow freely from the receiving tank 20 to the supply tank 10. It will thus be understood that the pressure along the gas return pipe 4 should experience only a small variation and that the first pressure P1 measured by the measurement device 540 thus does not exceed the first safety threshold equal to the fifth value E set at 0.63 barg.

When the first pressure P1 measured by the measurement device 540 does not exceed the first safety threshold, the pneumatic or hydraulic control member 542 does not close the first valve 520, and so most of the gas passes through the second branch 52 of the pressure regulation system 5. Specifically, the gas passes naturally along the easiest route, which in this case is the passage without a pressure drop through the first valve 520. It should nevertheless be remembered that a minimal part of the gas circulating in the gas return pipe 4 also passes through the first branch 51 when the first valve 520 is open.

A pressure control valve 40 is disposed downstream of the control device 54 and comprises at least one measurement member and one response member, in this case a first measurement member 401*a* and a first response member 402*a*. The pressure control valve 40 is more specifically an expansion valve controlled electrically by a control system onboard the floating structure which carries the supply tank 10. The pressure control valve 40 is positioned downstream of the pressure regulation system 5 in order that it controls and adjusts the pressure of the gas circulating in the gas return pipe 4, in particular at the outlet of the pressure regulation system 5. More specifically, the pressure control valve 40 allows a pressure drop in the gas circulating in the gas return pipe 4, this pressure drop being less than that brought about by the expansion member 510 but sufficient for the inlet of the gas into the supply tank 10.

According to a nonlimiting example, the pressure control valve 40 manages an inlet pressure of the gas, the range of values of which is between a third value C and a fourth value D, and sets an outlet pressure of the gas, the range of values of which is between the third value C and a sixth value F.

The third value C and the fourth value D may then be equal to 0.05 barg and 0.8 barg, respectively, while the outlet pressure of the gas between the third value C and the sixth value F are equal to 0.05 barg and 0.4 barg, respectively. It is found, from these values taken by way of example, that the pressure control valve 40 can bring about a drop in pressure of the gas of around 0.700 barg, but may also be passed through by the gas without the latter undergoing a consequent pressure drop.

An operator thus defines a fourth safety threshold on the first measurement member 401*a*, corresponding to a pressure that the supply tank 10 can withstand. The first measurement member 401*a* thus makes it possible to ensure that the pressure set by the operator is respected, in particular that the pressure control valve has brought about a sufficient pressure drop in the gas circulating in the gas return pipe 4, downstream of the pressure regulation system 5.

In the event that the first pressure P1 measured by the first measurement member 401*a* has exceeded the fourth safety threshold set by the operator, it sends a signal to the first response member 402*a*. The first response member 402*a* then acts on the pressure control valve 40 by closing it, making it possible to isolate the supply tank 10 from the receiving tank 20 as far as the return of gas is concerned.

The pressure control valve 40 is therefore disposed downstream of the control device 54 in order to play a safety role in the event of malfunctioning of the latter but also to bring about a final pressure drop in the gas leaving the pressure regulation system 5, before it enters the supply tank 10.

A second configuration of the fluid transfer device will now be described with reference to FIG. 3. It should be remembered that the structural and functional features of the components of the gas return pipe 4 and of the pressure regulation system 4 set out above apply to the second configuration of the fluid transfer device. For the elements already described, reference should be made to FIGS. 1 and 2 and the description given thereof.

In this second configuration of the fluid transfer device, the liquid natural gas is stored in the receiving tank 20 and the latter comprises a gas headspace at a second pressure P2 higher than the first pressure P1 of around 0.4 barg, this second pressure P2 being higher than 0.63 barg and for example between 0.700 barg and 10 barg. This second configuration of the fluid transfer device therefore corresponds to the situation in which the supply tank 10 is a membrane tank and the receiving tank 20 is a type B or type C tank.

During bunkering, the gas contained in the receiving tank 20 at the second pressure P2 will, firstly, pass mostly through the first valve 520 of the second branch 52, since this is the easiest path for the reasons set out above. Since the second pressure P2 is higher than the first pressure P1, the pressure downstream of the pressure regulation system 5 will increase, that is to say be higher than the first pressure P1, set at 0.4 barg.

The control device 54 positioned downstream of the pressure regulation system 5 detects, by virtue of its measurement device 540, an intermediate pressure, the latter then being higher than the first safety threshold equal to the fifth value E set at 0.63 barg. An intermediate pressure will be understood as being a pressure of the gas circulating in the gas return pipe 4, between the pressure regulation system 5 and the pressure control valve 40. In response to this exceeding of the first safety threshold, the pneumatic or hydraulic control member 542 of the control device 54 acts on the first valve 520, closing it.

The closure of the first valve 520 thus prevents the gas from passing through the second branch 52 and forces it to pass through the expansion member 510 of the first branch 51. The expansion member 510 thus manages an inlet pressure of the gas, the range of values of which is between a first value A and a second value B, and sets an outlet pressure of the gas, the range of values of which is between the third value C and the fourth value D. By way of example, the first value A and the second value B may be 0.05 barg and 9 barg, respectively. The expansion member 510 thus allows the gas subjected to the second pressure P2 to undergo a pressure drop of a minimum of 0.250 barg.

Just like in the first configuration set out in FIG. 2, the pressure control valve 40 makes it possible to check that the first pressure P1 of the supply tank 10 is still below the fourth safety threshold set by the operator, and, if the first measurement member 401*a* detects that said fourth safety threshold has been exceeded, acts by closing the pressure control valve 40 as described above.

Likewise, the pressure control valve 40 makes it possible, in this second configuration, to generate a pressure drop in the gas at the outlet of the pressure regulation system 5, and in the present case, in the event of an insufficient pressure drop in the gas brought about by the expansion member 510, for the inlet of said gas into the supply tank 10.

The pressure regulation system 5 is therefore a system that makes it possible to inject the gas from the receiving tank 20 into the supply tank 10 both when the first pressure P1 and the second pressure P2 are similar, one necessarily being higher than the other in order to generate the circulation of the gas flow, but also when these pressures P1, P2 are very different, in particular when the gas return pressure in the receiving tank 20 is higher than the pressure of the gas in the supply tank 10.

Figure 4:
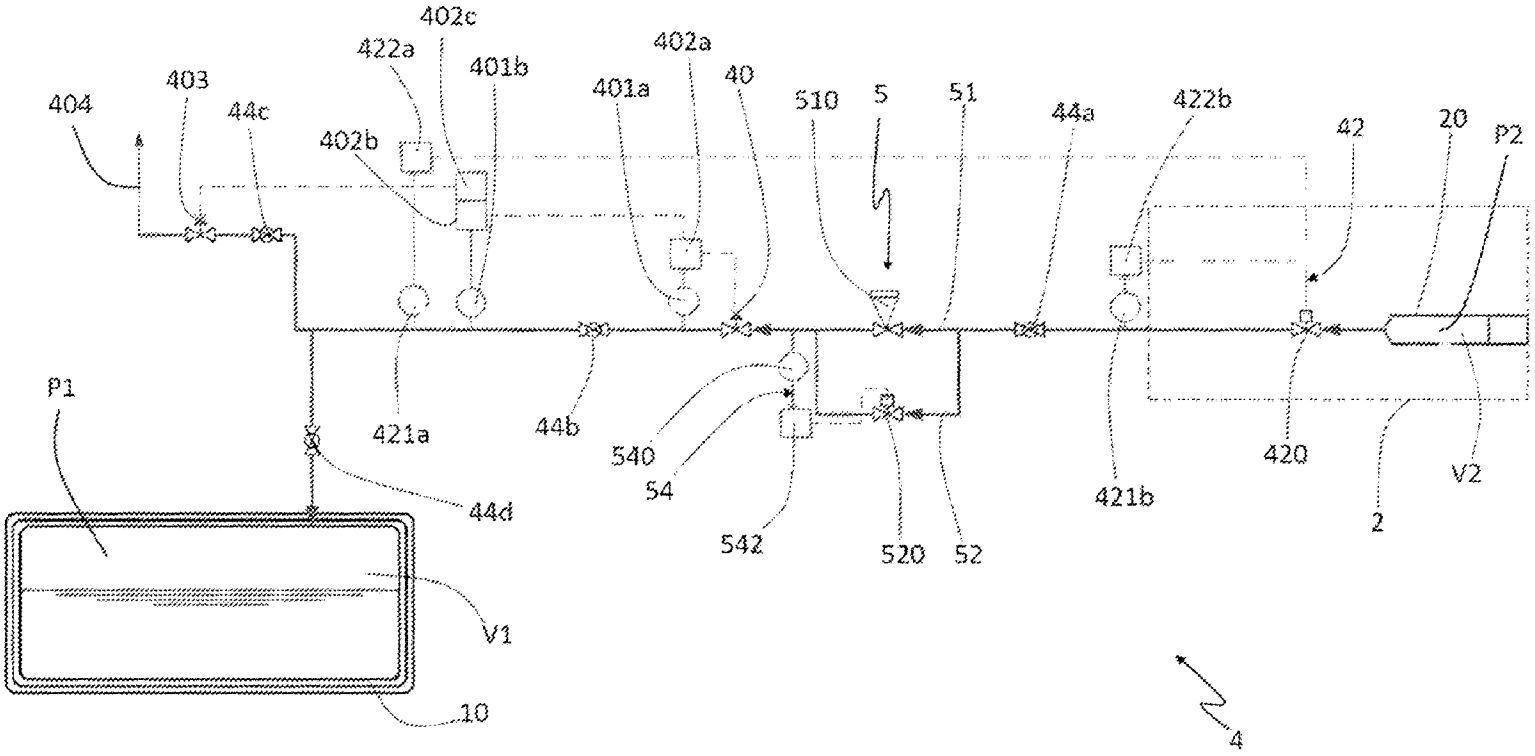
FIG. 4 is a schematic view of the assembly of the gas return pipe of the fluid transfer device according to the invention.

The gas return pipe 4 will now be described in its overall context as illustrated in FIG. 4, with the pressure regulation system 5 set out above in FIGS. 2 and 3.

In the context of understanding the following description, it should be remembered, as set out above, that the expansion member 510 allows a pressure drop of a minimum of 0.250 barg. In other words, the expansion member 510 acts on the pressure of the gas coming from the receiving tank 20, only when said gas reaches at least a value of around 0.8 barg, this value corresponding to the first pressure P1, equal to 0.63 barg, to which are added the minimum pressure drop of 0.250 barg brought about by the expansion member 510. It will thus be understood that, in the case of a second pressure P2 in the receiving tank 20 of between 0.63 barg and 0.8 barg, the expansion member 510 will have no impact on the latter. The need for the pressure control valve 40, making it possible, in the case set out above, to generate a complementary pressure drop in the gas leaving the expansion member 510 before it enters the supply tank 10, will also be understood.

A safety device 42 is disposed at the outlet of the receiving tank 20, i.e. upstream of the pressure regulation system 5. The safety device 42 is made up of an electrically or pneumatically controlled safety valve 420 and of at least one pressure measurement element. In the example illustrated, the safety device 42 comprises a first pressure measurement element 421*a* positioned downstream of the pressure regulation system 5 and a second pressure measurement element 421*b* positioned upstream of the pressure regulation system 5.

The first measurement element 421*a* makes it possible to measure the first pressure P1 on the gas return pipe 4, and more specifically the pressure downstream of the pressure regulation system 5 and therefore the pressure that prevails in the supply tank 10. The first measurement element 421*a* comprises a second safety threshold with a seventh value G, set for example at 0.66 barg. As explained above, the expansion member 510 has an impact on the reduction in the pressure only when the second pressure P2 is a minimum of 0.8 barg. Thus, if the second pressure P2 is between 0.63 barg and 0.8 barg, and if the pressure control valve 40 is defective and does not bring about the complementary pressure drop in the gas at the outlet of the pressure regulation system 5, said pressure P2 tends to increase an intermediate pressure situated between the regulation system 5 and the control valve 40. The first measurement element 421*a* therefore has the function of checking that the first pressure P1 does not reach a seventh value set at 0.66 barg, in the event of the expansion member 510 being inactive.

The first measurement element 421*a* therefore measures the first pressure P1 and compares it with the value of the second safety threshold equal to the seventh value G. If the pressure measured reaches the seventh value G of the second safety threshold set at 0.66 barg, the first measurement element 421*a* sends an electrical signal to a first response element 422*a* in that the latter closes the safety valve 420, then preventing any reentry of gas into the supply tank 10.

For its part, the second measurement element 421*b* is positioned upstream of the pressure regulation system 5, meaning that it measures the second pressure P2 that prevails in the receiving tank 20. The second measurement element 421*b* exhibits a third safety threshold equal to the second value B set at 9 barg. Thus, the second measurement element 412*b* measures the second pressure P2 of the gas directly at the outlet of the receiving tank 20 and compares it with the value fixed by the third safety threshold. If the pressure measured reaches the second value B of the third safety threshold, the second measurement element 421*b* sends an electrical signal to a second response element 422*b* in order that the latter closes the safety valve 420, then preventing any reentry of gas into the supply tank 10.

The value of the third safety threshold then corresponds to a pressure than can no longer be managed by the expansion member 510, i.e. a pressure that it is no longer capable of lowering to the lever expected in the supply tank 10.

As mentioned above, the pressure control valve 40 comprises the first measurement member 401*a*. In the embodiment illustrated in FIG. 4, the pressure control valve 40 likewise comprises a second measurement member 401*b* which is positioned between the first measurement member 401*a* and the first measurement element 421*a* of the safety device 42. An operator can then define a fifth safety threshold that may be for example 0.65 barg. The second measurement member 401*b* then makes it possible to compare the first pressure P1 measured on the gas return pipe 4 with the value of the fifth safety threshold. If the first pressure P1 measured by the second measurement member 401*b* reaches the fifth safety threshold, the latter sends a signal to a second response member 402*b*, which closes the pressure control valve 40.

The second measurement member 401*b* likewise communicates with a third response member 402*c*. The third response member 402*c* then comprises a sixth safety threshold corresponding to a value of 0.67 barg, measured by the second measurement member 401*b*. When the first pressure P1 measured by the second measurement member 401*b* reaches the value of the sixth safety threshold, the third response member 402*c* sends a signal to the pressure control valve 40 so as to force it remain closed, but also a signal to a release valve 403. The latter is an electrically controlled valve positioned at the end of the gas return pipe 4, that is to say downstream of the first pressure measurement element 421*a*. The opening of such a release valve 403 makes it possible to maintain the pressure in the supply tank 10 at an acceptable level, i.e. lower than 0.63 barg, via venting to the atmosphere by a vent tube 404.

It will thus be understood that the fluid transfer device has a set of means for safeguarding its gas return pipe 4. These safeguarding means function depending on the pressure measured along the gas return pipe 4, in particular depending on the first pressure P1 prevailing in the supply tank 10 or the second pressure P2 prevailing in the receiving tank 20.

When the first pressure P1 measured by the measurement device 540 is equal to or less than the value of its first safety threshold set at 0.63 barg, the pneumatic or hydraulic control member 542 with which it communicates leaves the first valve 520 open in order that the gas circulates through the second branch 52 without a pressure drop.

The first pressure measurement member 401*a* communicating with the first response member 402*a* makes it possible to safeguard the control device 54 of the pressure regulation system 5, meaning that it closes the control valve 40 positioned directly downstream of the pressure regulation system 5 when the first pressure P1 measured or estimated reaches the fourth safety threshold set by the operator. Usually, this fourth safety threshold is set at 0.63 barg.

If the second pressure P2 in the receiving tank 20 is between 0.63 barg and 0.8 barg, it increases the first pressure P1 that prevails in the supply tank 10. This increase in the first pressure P1 is then detected by the control device 54, which then closes the first valve 520. The gas then takes the first branch 51 and passes through the expansion member 510. However, the expansion member 510 has no effect on the reduction in this pressure, for the reasons set out above. Thus, the gas contained in the receiving tank 20 at the second pressure P2 of between 0.63 barg and 0.80 barg increases the first pressure P1 that prevails in the supply tank 10 when the pressure control valve 40 is defective as regards the complementary pressure drop in the gas at the outlet of the expansion member 510.

If the first pressure measurement member 401*a* is defective, such an increase in the first pressure P1 is then detected by the second pressure measurement member 401*b* which, by communicating with the second response member 402*b*, closes the pressure control valve 40 downstream of the pressure regulation system 5 when the first pressure P1 measured reaches the fifth safety threshold set at 0.65 barg. The closure of this pressure control valve 40 does not prevent the outlet of the gas directly from the receiving tank 20, however.

Thus, when filling of the first internal volume V1 continues on account of incomplete closure of the pressure control valve 40, the first measurement element 421*a* communicating with the first response element 422*a* closes the safety valve 420, positioned at the outlet of the receiving tank 20, of the safety device 42 when the first pressure P1 measured reaches the seventh value G equal to 0.66 barg, corresponding to the second safety threshold.

If the first measurement element 421*a* and the first response element 422*a* fail, the second measurement member 401*b* in communication with the third response member 402*c* makes it possible to close the pressure control valve 40 and to open the release valve 403. Such opening of the release valve 403 allows the gas to escape into the atmosphere via the vent tube 404. This action is effected when the first pressure P1 measured by the second measurement member 401*b* reaches the sixth safety threshold set at 0.67 barg.

If the second pressure P2 which prevails in the receiving tank 20 is higher than 0.8 barg, this tends to increase the first pressure P1 in the supply tank 10 to above 0.63 barg. This increase in the first pressure P1 is then detected by the measurement device 540, the first safety threshold of which is set at 0.63 barg, and which, in combination with the pneumatic or hydraulic control member 542, closes the first valve 520. The closure of the first valve 520 then forces the gas to pass through the expansion member 510 of the first branch 51 of the pressure regulation system 5 in order that it undergoes a pressure drop of a minimum of 0.250 barg before it enters the supply tank 10.

The pressure control valve 40 then allows the gas to pass through the expansion member 510, to effect a second pressure drop in the pressure of the gas before it enters the supply tank 10.

Lastly, if the pressure at the outlet of the receiving tank 20 measured by the second measurement element 421*b* of the safety device 42 reaches the third safety threshold with the second value B, set for example at 9 barg, a signal is sent by the second response element 422*b* to close the safety valve 420. This action prevents the gas contained in the receiving tank 20 from reaching the supply tank 10, since such a second pressure P2 can no longer be managed by the expansion member 510.

At least one isolation valve 44*a*, 44*b*, 44*c* may be disposed along the gas return pipe 4. In the example illustrated, the gas return pipe 4 comprises four isolation valves 44*a*, 44*b*, 44*c*.

The isolation valves 44 are manually controlled valves controlled by the action of an operator, in particular in the event of a significant malfunction of the abovementioned electrically controlled safety systems of the gas return pipe 4. These isolation valves 44 make it possible to prevent any circulation of the gas from the receiving tank 20 to the supply tank 10.

A first isolation valve 44*a* is disposed upstream of the pressure regulation system 5. A second isolation valve 44*b*, a third isolation valve 44*c* and a fourth isolation valve 44*d* are disposed downstream of the pressure regulation system 5.

More specifically, the second isolation valve 44*b* is positioned downstream of the pressure control valve 40 and upstream of the second pressure measurement member 401*b*.

The third isolation valve 44*c* is positioned upstream of the release valve 403 and downstream of the first measurement element 421*a*, such that it prevents any circulation of gas from the gas return pipe 4 to the vent tube 404, in particular if the release valve 403 ruptures or its electrically controlled closure system malfunctions.

Lastly, the fourth isolation valve 44*d* is positioned at the inlet of the supply tank 10, between this inlet and the first measurement element 421*a*. This fourth isolation valve 44*d* is then open during the bunkering of the receiving tank 20 and is closed if one of the electrically controlled valves positioned upstream malfunctions.

Of course, the invention is not limited to the examples that have just been described and numerous modifications can be made to these examples without departing from the scope of the invention.

The invention, as has just been described, clearly achieves its set objective, and makes it possible to propose a system for regulating the tank return pressure, making it possible to fill the tank of a floating structure equipped with membrane tanks or self-supporting tanks from another floating structure equipped with at least one membrane tank. Variants that are not described here could be implemented without departing from the context of the invention, provided that, according to the invention, they comprise a fluid transfer device according to the aspect of the invention.

The invention claimed is:

1. A device for transferring a liquefied gas from a supply tank of a first structure to a receiving tank of a second structure, at least one of the structures being a floating structure, the device comprising:

at least one pipe for loading the receiving tank with liquid and at least one pipe for returning the gas present in the receiving tank to the supply tank, wherein the gas return pipe comprises at least one pressure regulation system comprising at least one first branch equipped with an expansion member for expanding the gas and a second branch disposed in parallel with the expansion member and equipped with a valve configured to allow or interrupt circulation of the gas in the second branch.

2. The device as claimed in claim 1, further comprising a control device which operates the valve configured to allow or interrupt circulation of the gas in the second branch, depending on a first pressure measured on the gas return pipe.

3. The device as claimed in claim 2, wherein the pressure regulation system is configured to keep the valve configured to allow or interrupt circulation of the gas in the second branch closed when the first pressure measured on the gas return pipe is higher than a first safety threshold, the gas passing through the expansion member.

4. The device as claimed in claim 2, wherein the pressure regulation system is configured to keep the valve configured to allow or interrupt circulation of the gas in the second branch open when the first pressure measured on the gas return pipe is lower than or equal to a first safety threshold.

5. The device as claimed in claim 1, wherein the expansion member is controlled mechanically.

6. The device as claimed in claim 1, wherein the expansion member is configured to:

manage an inlet pressure of the gas, a range of values of the inlet pressure being between a first value and a second value, and set a gas outlet pressure, a range of values of the outlet pressure being between a third value and a fourth value.

7. The device as claimed in claim 6, wherein the valve configured to allow or interrupt circulation of the gas in the second branch allows gas circulation in the second branch up to a fifth value of the pressure value of the gas, the fifth value being higher than the first value and lower than the fourth value.

8. The device as claimed in claim 1, wherein the gas return pipe comprises a pressure control valve disposed between the pressure regulation system and the supply tank.

9. The device as claimed in claim 6, wherein the gas return pipe comprises a pressure control valve disposed between the pressure regulation system and the supply tank, and the pressure control valve is configured to:

manage an inlet pressure of the gas, a range of values of which is between the third value and the fourth value, and set a gas outlet pressure, the range of values of which is between the third value and a sixth value lower than the fourth value.

10. The device as claimed in claim 9, wherein the gas return pipe comprises a safety device disposed between the receiving tank and the pressure regulation system and configured to interrupt the circulation of the gas in the gas return pipe when the gas pressure measured between the pressure control valve and the supply tank exceeds a first safety threshold with a value higher than the sixth value.

11. The device as claimed in claim 10, wherein the safety device is configured to interrupt the circulation of the gas in the gas return pipe when the gas pressure measured between the receiving tank and the safety device exceeds a second safety threshold with a value higher than the second value.

12. A structure, comprising:

at least one said device for transferring a fluid as claimed in claim 1; and at least one supply tank configured to contain gas in a liquid state or a receiving tank configured to contain gas in the liquid state.

13. A system for loading a liquid natural gas, which combines at least one said structure comprising the receiving tank configured to contain liquid natural gas and at least one said structure as claimed in claim 12, which comprises at least the supply tank, at least one of the structures being a floating structure.

14. The system as claimed in claim 13, wherein the supply tank is configured to operate at a pressure of between 0.05 barg and 0.700 barg, and the receiving tank is configured to operate at a pressure of between 0.05 barg and 10 barg.

15. A method for transferring a liquid natural gas from a supply tank to a receiving tank, which employs the device as claimed in claim 1.

16. The transfer method as claimed in claim 15, wherein the valve configured to allow or interrupt circulation of the gas in the second branch is kept closed when a first pressure measured on the gas return pipe is higher than a first safety threshold, the gas then passing through the expansion member, or the valve configured to allow or interrupt circulation of the gas in the second branch is kept open when the first pressure measured on the gas return pipe is lower than or equal to the first safety threshold.

* * * * *